US009371595B2

(12) United States Patent
Ran

(10) Patent No.: US 9,371,595 B2
(45) Date of Patent: Jun. 21, 2016

(54) FROST FREE SURFACES AND METHOD FOR MANUFACTURING THE SAME

(75) Inventor: Chunbo Ran, Shanghai (CN)

(73) Assignee: Conopco, Inc., Englewood Cliffs, NJ (US)

( * ) Notice: Subject to any disclaimer, the term of this patent is extended or adjusted under 35 U.S.C. 154(b) by 1063 days.

(21) Appl. No.: 13/505,791

(22) PCT Filed: Nov. 10, 2009

(86) PCT No.: PCT/CN2009/001242

§ 371 (c)(1),
(2), (4) Date: Aug. 9, 2012

(87) PCT Pub. No.: WO2011/057422

PCT Pub. Date: May 19, 2011

(65) Prior Publication Data

US 2012/0325666 A1 Dec. 27, 2012

(51) Int. Cl.

| | |
|---|---|
| ***C25D 11/24*** | (2006.01) |
| ***C25D 11/04*** | (2006.01) |
| ***C25D 11/12*** | (2006.01) |
| ***C25D 11/16*** | (2006.01) |
| ***F25D 21/04*** | (2006.01) |
| *F25D 23/00* | (2006.01) |

(52) U.S. Cl.

CPC ..... *C25D 11/04* (2013.01); *C25D 11/045* (2013.01); *C25D 11/12* (2013.01); *C25D 11/16* (2013.01); *C25D 11/24* (2013.01); *F25D 21/04* (2013.01); *F25D 23/00* (2013.01)

(58) Field of Classification Search

CPC ..... C25D 11/18; C25D 11/24; C25D 11/246; C25D 11/04; C25D 11/08; C25D 11/10; C25D 11/12; F25D 21/04

USPC ..... 205/323–333, 229, 198–204; 977/811

See application file for complete search history.

(56) References Cited

U.S. PATENT DOCUMENTS

| | | | | |
|---|---|---|---|---|
| 4,513,579 | A | 4/1985 | Anderson et al. | |
| 6,464,853 | B1 * | 10/2002 | Iwasaki | C25D 11/045 205/118 |
| 6,592,078 | B2 | 7/2003 | Porte et al. | |
| 6,652,669 | B1 * | 11/2003 | Reihs et al. | 148/241 |
| 7,087,876 | B2 | 8/2006 | Petrenko | |
| 7,320,226 | B2 | 1/2008 | Strauss | |
| 8,641,884 | B2 * | 2/2014 | Hayashi | C25D 11/12 204/280 |
| 2005/0066667 | A1 | 3/2005 | Strauss | |
| 2006/0024478 | A1 | 2/2006 | D'urso et al. | |
| 2006/0037477 | A1 | 2/2006 | Lopez et al. | |
| 2009/0194914 | A1 | 8/2009 | Uozu et al. | |
| 2011/0229667 | A1 * | 9/2011 | Jin | B81C 1/00206 428/34.1 |

FOREIGN PATENT DOCUMENTS

| | | | |
|---|---|---|---|
| CN | 1070696 | A | 4/1993 |
| CN | 1566874 | A | 1/2005 |
| CN | 101139730 | A | 3/2008 |
| CN | 101139730 | A | 3/2008 |
| CN | 101423945 | A | 5/2009 |
| CN | 101481814 | A | 7/2009 |
| CN | 101481814 | A | 7/2009 |
| KR | 1020010043296 | A | 5/2001 |
| WO | WO9409074 | A1 | 4/1994 |
| WO | WO9623043 | A1 | 8/1996 |
| WO | WO9957185 | A1 | 11/1999 |
| WO | WO0039368 | | 7/2000 |
| WO | WO2006023413 | A1 | 3/2006 |
| WO | WO2007041466 | A1 | 4/2007 |
| WO | WO2007149617 | A1 | 12/2007 |
| WO | WO2008004827 | A1 | 1/2008 |
| WO | WO2008085550 | A2 | 7/2008 |
| WO | WO2008137209 | A1 | 11/2008 |
| WO | WO2009097790 | A1 | 8/2009 |

OTHER PUBLICATIONS

Ran C. et al "Wetting on Nanoporous Alumina Surface: Transition between Wenzel and Cassie States Controlled by Surface Structure" Langmuir, 2008, p. 9952-9955, published Aug. 15, 2008.*

Aravamudhan, et al., Porous silicon templates for electrodeposition of nanostructures, Appl Phys, Jan. 1, 2007, 773-780, A87.

Gao, et al., Template synthesis of single-crystal Cu nanowire arrays by electrodeposition, Appl Phys, Jun. 20, 2001, 251-254, A 73.

Li, et al., Fabrication of highly ordered nanoporous alumina films by stable high-field anodization, Nanotechnology, Jan. 1, 2006, 1-5, 17.

Metz, et al., Density Viscosity & Dielectric Constant of Tetrahydrofuran between 70 and 30, J Phys Chem, Jan. 1, 1967, 1158, 71.

(Continued)

*Primary Examiner* — Nicholas A Smith
*Assistant Examiner* — Brian W Cohen
(74) *Attorney, Agent, or Firm* — Gerard J. McGowan, Jr.

(57) ABSTRACT

Frost-free surfaces and methods for manufacturing such surfaces are described. The frost-free surfaces reduce ice build-up, prevent vapor condensation and reduce adhesion force between ice and a solid substrate. The surfaces can be on parts used in devices where superhydrophobic properties may be obtained post or during device manufacturing. The superhydrophobic properties are the result of aluminum oxide clusters made on such surfaces.

18 Claims, No Drawings

(56) References Cited

OTHER PUBLICATIONS

Pang, et al., Electrochemical synthesis of ordered alumina nanowire arrays, J Solid State Electochem, Jan. 1, 2003, 344-347, 7.
Pang, et al., Micropolarizer of Ordered Ni Nanowire Arrays Embedded in Porous Anodic Alumina Membrane, Chin Phys Lett, Aug. 3, 2002, 144, 20, No. 1.
Pesika, et al., Fabrication of Complex Architectures Using Electrodepositin into Patterned Self-Assembled Monolayers, Nano Letters, Feb. 17, 2006, 1023-1026, 6, No. 5.
Sibottier, et al., Factors Affecting the Preparation & Properties of Electrodeposited Silica Thin Fimls Funcationalized with Amine or Thiol Groups, Langmuir, Jul. 18, 2006, 8366-8373, 22.
Tang, et al., Experimental Study on Deicing Performance of Carbon Fiber Reinforced Conductive Concrete, J Mater Sci Technol, Jan. 1, 2005, 113-117, 21, No. 1.
Xiang, et al., Microstructured horizontal alumina pore arrays as growth templates for large area few & single nanowire devices, Phys Stat Sol, Jan. 1, 2008, 59-61, 2, No. 2.
Xiao, et al., Fabrication of Alumina Nanotubes and Nanowires by Etching Porous Alumina Membranes, Nano Letters, Oct. 9, 2002, 1293-1297, 2, No. 11.
May 30, 2008, Stateic Dielectric Constants of Pure Liquids and Binary Liquid Mixtures, Springerlink, 17, 1-4.
International Search Report, PCT/CN2009/001242, mailed Jul. 29, 2010, pp. 1-4.
Menini et al., PTFE-coated Anodized Aluminum Alloy 6061 with Icephobic Properties, Internet article, 2009, XP055233159; http://iwais.compusult.net/html.
Supplemental Search Report in EP09851178, Dec. 10, 2015.
Wang et al., Fabrication of superhydrophobic surfaces on aluminum, Applied Surface Science, Jun. 30, 2008, pp. 5599-5601; XP022680664, 254.

* cited by examiner

FROST FREE SURFACES AND METHOD FOR MANUFACTURING THE SAME

FIELD OF THE INVENTION

The present invention is directed to a frost-free surface and a method for making the same. More particularly, the present invention is directed to a frost-free surface for devices where the surface prevents ice build-up and resists vapor condensation when subjected to freezing conditions. The surface comprises nanoclusters of aluminum oxide that have been fabricated via a process that comprises at least one electrochemical oxidation step, and an etching or coating step.

BACKGROUND OF THE INVENTION

Ice formation/adhesion on internal surfaces of devices such as freezers can create problems, especially on freezers that are used for point-of-purchase sales. Ice build-up (resulting from warmer air with moisture entering a freezer) can interfere with the efficiency of a freezer and leave less room for food storage within compartments of the freezer.

With commercial freezers used for point-of-purchase applications, ice build-up is very unattractive for a consumer to see and often interferes with the look and presentation of product being sold. In fact, ice build-up within freezers can cover or hide product, like ice cream, meats and/or frozen vegetables, resulting in product not being selected by a consumer and often spoiling prior to being sold.

Certain freezers need to be put out of service in order to defrost. Other frost-free freezers have heating elements to melt ice which is collected as water, or blow air through the food compartment of the freezer to remove moisture laden air which is known to cause ice build-up.

Still other devices have problems with ice build-up under freezing conditions. Airplanes, automobiles, locking mechanisms as well as electronic switches are additional examples of the types of devices that can fail to function under freezing conditions.

The concern with many defrosting mechanisms is the over use of energy and affordability. Moreover, lowering temperatures of food compartments within devices like freezers typically causes food product quality to inevitably be compromised.

There is an increasing interest to create surfaces that do not display ice build-up and attract condensation under freezing conditions. There is an especially preferred interest in developing freezers that do not display ice build-up within their food storing compartments, especially through mechanisms that do not require additional energy to heat such compartments. Furthermore, there exists a desire to convert devices with poor or no de-icing capabilities into devices that are frost-free without relying on complicated heating or other electrical systems. This invention, therefore, is directed to a surface that displays reduced ice build-up and resists vapor condensation and a method for making the same. The surface typically is prepared from parts or panels that may be treated post or during device manufacturing whereby the parts or panels comprise nanoclusters of aluminum oxide that have been fabricated via a process that comprises at least one electrochemical oxidation step, and an etching or coating step.

Additional Information

Efforts have been disclosed for making frost-free freezers. In U.S. Pat. No. 4,513,579, a freezer with a moisture-absorbing regenerable filter is described.

Other efforts have been disclosed for decreasing ice adhesion. In U.S. Pat. No. 7,087,876, a system for melting interfacial ice with electrodes and an AC power source is described.

Still other efforts have been disclosed for making freezers with defrost functions. In U.S. Pat. No. 7,320,226, a freezer with a heating device for heating and defrosting a cooling surface is described.

None of the additional information above describes a surface having frost-free properties prepared post or during device manufacturing whereby the surface comprises nanoclusters of aluminum oxide that have been fabricated through a process that includes an electrochemical oxidation step, and an etching or coating step.

SUMMARY OF THE INVENTION

In a first aspect, the present invention is directed to a frost-free surface whereby the surface is superhydrophobic and comprises nanoclusters of aluminum oxide.

In a second aspect, the present invention is directed to a method for making a frost-free surface, the method comprising the steps of:

- obtaining an aluminum comprising part, the aluminum comprising part suitable for assembly onto a new device or obtained from an existing device;
- subjecting the aluminum comprising part to at least one electrochemical oxidation step for an effective amount of time to create a part comprising a fabricated anodic aluminum oxide layer thereon;
- subjecting the part comprising the fabricated anodic aluminum oxide layer thereon to an etching step or a coating step to produce a superhydrophobic part comprising aluminum oxide;
- assembling the superhydrophobic part onto the new or the existing device.

All other aspects of the present invention will more readily become apparent upon considering the detailed description and examples which follow.

Aluminum oxide is meant to mean $Al_2O_3$. Anodic aluminum oxide is the aluminum oxide layer fabricated onto an aluminum part in an electrochemical oxidation step when the part comprising aluminum is used as the anode. Superhydrophobic, as used herein, means having a contact angle of at least 145° against water. Frost-free, as used herein, means a superhydrophobic surface that displays a reduction in ice build-up, reduction in the adhesion force between ice and a surface as well as a reduction in attraction of vapor condensation on a surface. Nanocluster means a collection of aluminum oxide, preferably pyramid-like in shape, where the nanocluster is from 800 nm to 15 microns in width and 700 nm to 10 microns in height. Contact angle, as used herein, means the angle at which a water/vapor interface meets a solid surface. Such an angle may be measured with a goniometer or other water droplet shape analysis system. Existing device is a device having already been manufactured. New device is a device being assembled within the manufacturing process. Part is meant to include panel like a freezer panel but is generally meant to mean any object that may be treated according to the method of this invention. Device is meant to mean an item that includes a part treated via the method of this invention like an airplane, automobile, lock, and especially, a freezer for food products. Assembly onto is meant to include within a device. For the avoidance of doubt, therefore, assembly onto includes, for example, the assembly of panels within a freezer.

All ranges defined herein are meant to include all ranges subsumed therein unless specifically stated otherwise. Comprising, as used herein, is meant to include consisting essentially of and consisting of.

DETAILED DESCRIPTION OF THE PREFERRED EMBODIMENTS

The only limitations with respect to the part that may be used in this invention is that the same may be used as an anode in an electrochemical oxidation process. Such a part may be pure aluminum or an aluminum alloy and comprise elements such as copper, silicon, iron, magnesium, manganese, zinc, titanium, mixtures thereof or the like. In a preferred embodiment, the part comprises at least 90%, and preferably, at least 95 to 100%, and most preferably, at least 99 to 100% by weight aluminum, including all ranges subsumed therein.

Moreover, the devices which may employ the parts of this invention can comprise, for example, cooling mechanisms that use propane, carbon dioxide, hydrofluorocarbons, chlorofluorocarbons, mixtures there or the like. The preferred cooling mechanism is often country dependent and the most preferred mechanism will almost always be the one deemed most environmentally friendly.

When practicing the present invention, the part is obtained and preferably thoroughly washed and dried. The washing method will be dependent on the type of soil being removed from the part. Typically, however, solvents like water, soapy water, acetone, and solutions of sodium hydroxide and/or sodium bicarbonate may be used to clean the part. Of course, non-solvent based cleaning techniques may also be used if desired. Therefore, for example, vibrating, blowing and/or ultrasonification techniques may be used to clean or further clean the part targeted for treatment. The size of the part treated according to this invention is not critical as long as suitable equipment may be obtained to conduct the inventive method. Typically, however, the parts treated according to this invention have an area of less than 100 $m^2$, and preferably, less than 50 $m^2$, and most preferably, from about 0.1 to about 20 $m^2$, including all ranges subsumed therein. Often, such parts have a thickness that does not exceed 2 cm, and preferably, does not exceed 1.25 cm. In a most preferred embodiment, the thickness of the part is from about 0.01 cm to about 0.75 cm, including all ranges subsumed therein. Moreover, the shape of the part is not limited and the surface may, for example, be smooth, comprise grooves or be embossed. When the device having parts being treated according to this invention is a freezer, such freezers can be made commercially available from suppliers like Bush Refrigeration, Dragon Enterprise Co., Ltd., CrownTonka Walkins, Ningbo Jingco Electronics Co., Ltd. and Qingdao Haier Refrigerator Co., Ltd.

Subsequent to obtaining a cleaned part, the part is preferably subjected to a first electrochemical oxidation process whereby the part is submerged in a reagent solution comprising acid like, for example, phosphoric, sulfuric, hydrochloric, acetic, citric, tartaric or lactic acid, as well as mixtures thereof or the like.

The reagent solution typically comprises from 2 to 12% by weight, and preferably, from 3 to 10%, and most preferably, from 5 to 7% by weight acid, including all ranges subsumed therein. In an often preferred embodiment, the reagent solution comprises from 3 to about 20%, and most preferably, from about 6 to about 15% by weight alcohol, including all ranges subsumed therein. The preferred alcohol is a $C_2$-$C_6$ alcohol and the most preferred alcohol used is ethanol. The balance of the reagent solution typically is water.

Subsequent to submerging the part in reagent solution, it is preferred to stir the solution in order to ensure efficient electrochemical oxidation. The part acts as the anode in the reaction and a cathode like, for example, graphite, copper, platinum, stainless steel or the like should be used in the process. Current is typically supplied with a conventional power supplier such as one made commercially available from suppliers like Agilent, Cole-Parmer or Omron. Typically, the electrochemical oxidation is carried out at a solution temperature from −10 to 35° C., and preferably, from −8 to 20° C., and most preferably, from −6 to 12° C., including all ranges subsumed therein. Current is typically from 0.05 to 1 amp, and preferably, from 0.07 to 0.5 amp, and most preferably, from 0.08 to about 0.2 amp, including all ranges subsumed therein. The voltage during the electrochemical oxidation typically should not exceed 200 volts. Preferably, the voltage is from about 50 to about 190 volts, and most preferably, from about 100 to about 180 volts, including all ranges subsumed therein. The electrochemical oxidation preferably runs for 0.05 to 2 hours, and preferably, from 0.5 to 2 hours, and most preferably, from 0.75 to 1.5 hours, including all ranges subsumed therein.

Subsequent to the electrochemical oxidation of the part, the same comprises a fabricated anodic aluminum oxide layer thereon.

In a preferred embodiment, the part, with the fabricated anodic aluminum oxide layer is subjected to an aluminum oxide removal step whereby the fabricated layer made is preferably removed via an oxidation layer removal step and then subjected to at least a second electrochemical oxidation step.

The oxidation layer removal step is limited only to the extent that it is one which removes, if not all, substantially all of the coating of fabricated anodic aluminum oxide previously made on the part and renders the part suitable for at least one additional electrochemical oxidation step. In a preferred embodiment, the oxidation layer removal step is achieved with an aqueous acidic solution comprising from about 2% to about 12%, and preferably, from about 2.5% to about 9%, and most preferably, from about 3% to about 7% by weight acid, including all ranges subsumed therein. Preferred acids suitable for use in such solutions to remove the coating in the oxidation layer removal step are phosphoric acid, sulfuric acid, hydrochloric acid or a mixture thereof. Most preferably, the acid used is phosphoric acid in an aqueous solution comprising from 3 to 7% by weight acid.

When removing the fabricated anodic aluminum oxide layer, the part is coated or sprayed with solution or preferably submerged in solution until substantially all fabricated layer is removed. Typically, this step is conducted for a period of 10 minutes to one (1) hour, and preferably, from 20 minutes to 45 minutes, including all ranges subsumed therein. The temperature at which the aluminum oxide layer is removed is typically from 50 to 80° C., and preferably, from 55 to 70° C., including all ranges subsumed therein.

Subsequent to removing the fabricated anodic aluminum oxide layer, the part is, again, subjected to at least one additional, and preferably, one additional electrochemical oxidation step. The additional electrochemical oxidation step is essentially a repeat of the first electrochemical oxidation step except that the reaction time is typically from 2.5 to 8, and preferably, from 3 to 7, and most preferably, from 3.5 to 5.5 hours, including all ranges subsumed therein. Subsequent to performing the additional or final electrochemical oxidation step on the panel, a final anodic aluminum oxide layer is fabricated thereon.

The final anodic aluminum oxide layer is porous and surprisingly uniform in nature, comprising holes or pores having diameters from 50 to 120 nm, and preferably, from 60 to 100 nm, and most preferably, from 70 to 90 nm, including all ranges subsumed therein. The depth of the pores after the final (i.e., preferably second) electrochemical step is typically from 2 to 10 microns, and preferably, from 3 to 8 microns, and most preferably from 4 to 6 microns, including all ranges subsumed therein. Furthermore, the interhole distance of the pores making up final anodic aluminum oxide layer is typically from about 200 to 500 nanometers, and preferably, from 300 to 475 nanometers, and most preferably, from 350 to 450 nanometers, including all ranges subsumed therein.

The part comprising the final anodic aluminum oxide layer may be etched in order to generate a preferred superhydrophobic panel with a superior array of nanoclusters. The etching may be achieved with an aqueous acidic solution like the one described to remove aluminum oxide in the oxidation layer removal step. The etching step is typically for about 2 to 7 hours, preferably, from 2.5 to 6 hours, and most preferably, from 3 to 5 hours, including all ranges subsumed therein. The temperature at which etching is conducted is typically from 20 to 50° C., and preferably, from 25 to 45° C., and most preferably, from 25 to 35° C., including all ranges subsumed therein.

The resulting frost-free and superhydrophobic part comprises nanoclusters of aluminum oxide whereby the nanoclusters are between 800 nm to 15 microns, and preferably, from 3 to 10 microns, and most preferably, from 4 to 7 microns in width, including all ranges subsumed therein. The height of the nanoclusters is from 700 nm to 10 microns, preferably, from 900 nm to 5 microns, and most preferably, from 1 to 4 microns, including all ranges subsumed therein. Such nanoclusters are typically from 10 to 40 microns apart (peak-to-peak) from each other, and preferably, 12 to 30 microns, and most preferably, 15 to 25 microns apart from each other, including all ranges subsumed therein.

Alternatively, the final anodic aluminum oxide layer may be coated with a laminate (i.e., hydrophobilizing agent) in lieu of being etched in order to generate a panel with preferred superhydrophobic properties. Such a laminate includes aero gels like those comprising a (halo)alkyltrialkoxysilicone (e.g., trifluoropropyltrimethoxysilicone) as well as coatings having polydimethylsiloxane. Others include (3-chloropropyl)trimethoxysilane and other art recognized polyhydroxy silanes. When applied, the laminate typically is less than 2 nm, and preferably, from 0.25 to 1.75 nm, and most preferably, from 0.75 to 1.5 nm, including all ranges subsumed therein. Application of the laminate is achieved by any art recognized technique, including techniques which include spraying, dipping and/or brushing steps followed by a drying step. Suppliers of such laminates include, for example, Microphase Coatings Inc., the Sherwin Williams Company, and Changzhou Wuzhou Chemical Co., Ltd.

In yet another alternative, the aluminum comprising part subjected to the method of this invention may originally comprise a flat aluminum oxide layer applied for or by an original equivalent manufacturer. Such a layer is typically 3 to 10 microns thick.

When the aluminum part selected for treatment according to this invention comprises an original aluminum oxide layer, the same is preferably subjected to one electrochemical oxidation under conditions consistent with what is described herein as the first electrochemical oxidation. Often, however, the electrochemical oxidation of parts with an original aluminum oxide layer is from 1 minute to 1.5 hours, and preferably, from 10 to 45 minutes, and most preferably, from 15 to 35 minutes, including all ranges subsumed therein. Typically, the electrochemical oxidation to the part comprising an original aluminum oxide layer adds an additional 2-12 microns, and preferably, 3 to 10 microns, and most preferably, 3.5 to 8.5 microns of fabricated anodic aluminum oxide layer. Such a layer comprises layered nanoclusters of aluminum oxide. These layered nanoclusters are similar in size to the nanoclusters described herein except that the layered nanoclusters are denser than the nanoclusters resulting from the etching of part originally having no aluminum oxide layer where denser means the layered nanoclusters are typically from 300 nm to 5 microns, and preferably, from 350 nm to 2 microns, and most preferably, from 400 to 600 nm apart, including all ranges subsumed therein. The layered nanoclusters are preferably coated with laminate in the manner previously described to produce another desired superhydrophobic and frost-free part.

The resulting frost-free parts made according to this invention typically have contact angles which are greater than 145°, and preferably, from 145 to 158°, and most preferably, from 146 to 155°, including all ranges subsumed therein.

Subsequent to generating the superhydrophobic parts described in this invention, the same may be returned to a device previously used or assembled into a new device.

In a most preferred embodiment, the parts described herein are panels for a freezer whereby the same do not display ice build-up and resist vapor condensation (i.e., are frost-free) even in the absence of energy requiring de-icing systems.

The following examples are provided to facilitate an understanding of the present invention. The examples are not intended to limit the scope of the claims.

Example 1

An aluminum panel (99.99% purity, 0.25 mm thickness about 26 $cm^2$) was degreased by submerging the panel in acetone and subjecting the same to ultrasonification for five (5) minutes. The aluminum panel was removed from the acetone and then rinsed in water. Aluminum anodization was preformed using a regulated and commercially available direct current power supply. A large glass beaker (2 L) and bath were used to maintain temperature. Anodization was performed in a $H_3PO_4$—$H_2O$—$C_2H_5OH$ (100 ml:1000 ml:200 ml) system at −5° C. The degreased aluminum panel was used as the anode and graphite was set as the cathode. The initial voltage was set at 160 V, and current was 0.1 mA. After anodization (electrochemical oxidation) for one hour, an aluminum oxidation layer was formed on the aluminum panel. The resulting oxidation layer was removed with 5% (wt) $H_3PO_4$ at 60° C. for one hour. Subsequently, a second anodization was conducted on the aluminum panel following the same procedure as the initial anodization but for a period of four hours. Obtained was a panel comprising porous anodic aluminum oxide fabricated thereon with pores of uniform diameter (about 80 nm) and depth (about 5 microns).

The panel comprising porous anodic aluminum oxide was etched with 5% $H_3PO_4$ at 30° C. to obtain the desired superhydrophobic surface. After etching for 3 hours and 40 minutes, the desired nanocluster surface was obtained (nanoclusters about 5 microns wide, about 3 microns in height and about 20 microns apart as determined using scanning election microscope imaging). The contact angle of this surface was tested against water using a commercially available goniometer. The contact angle of the surface was 150°.

To compare the hydrophobic properties of panels with different surfaces, ice adherence tests using air in a freezing environment were conducted. Pure aluminum panels, panels with porous alumina coatings and the panels made in this example were used. The pure aluminum panel was hydrophilic with a contact angle of 70°. The panel with porous alumina was also hydrophilic with a contact angle of 80°. The panel made according to this invention had a superhydrophobic surface with, again, a contact angle of 150°.

The panels were placed in a freezer (−20° C.) for 15 days. Any ice attachment was recorded. The hydrophilic aluminum panel and the hydrophilic panel with porous alumina visually displayed good affinity for ice build-up. In contrast, the panel treated according to this invention showed essentially no ice build-up. These comparisons indicate that the panels treated according to this invention, unexpectedly, have excellent ice-phobic/frost-free properties for freezer applications.

Another test was conducted to check the efficiency of ice build-up on the panels. Portions of the panels above were cut to the same shape (area of 1.61 $cm^2$). Before being put into a freezer, the samples were weighed. The weight of the aluminum panel, panel with porous alumina and the panel of this invention were 74.2, 69.0, and 58.4 mg, respectively. After being placed in a freezer (20° C.) for one month, the weights of these samples were measured to assess the amount of ice attachment on the surfaces of the panels. The weights were 101, 91, and 64 mg, respectively for the panels. Therefore, the amount of attached ice was 16.6, 13.7, and 3.6 $mg/cm^2$ on the aluminum panel, panel with porous alumina and panel made according to this invention, respectively. The amount of ice attached indicates that the panels made according to this invention unexpectedly have superhydrophobic surfaces that have ice-phobic properties.

Example 2

An embossed aluminum panel used and removed from a freezer (with a flat aluminum oxide layer of 6-8 microns) was degreased by ultrasonication in acetone for 5 minutes and rinsed in water. An electrochemical oxidation step was performed with a regulated direct current power supply. A large glass beaker (2 L) and a bath were used to maintain temperatures. Anodization was performed in a $H_3PO_4$—$H_2O$—$C_2H_5OH$ (100 ml:1000 ml:200 ml) system at 15° C. In the oxidation step, the embossed aluminum plate was used as the anode and graphite was set as the cathode. The initial voltage was set at 150 V, and current set at 0.1 mA. After anodization for 40 minutes, a fabricated anodic aluminum oxide layer comprising layered nanoclusters were formed (about 4.5 microns in height) on the surface of the plate. The nanoclusters were dense and about 500 nm apart.

A silicon comprising laminate (ethanol solution ($5_m$M) of $C_3H_7S_i$ $(OCH_3)_3$) was applied (about 1 nm) to the plate. The resulting panel with laminate was superhydrophobic and surprisingly displayed no ice attachment after being placed in a freezer for about one (1) week.

The results indicate that embossed aluminum panels from existing freezers may be treated according to this invention and returned to the freezer to yield a frost-free freezer.

Example 3

Panels similar to those obtained via the process described in Examples 1 and 2 were placed in a freezer (about 0° C.) for about 1 hour. Aluminum panels not treated according to this invention were also placed in the freezer under similar conditions. The panels were removed from the freezer and placed on the top of beakers containing hot (70° C.) water for 3 minutes. The panels were removed from the beakers and a visual examination surprisingly revealed significantly less vapor condensation on the panels treated according to this invention when compared to conventional aluminum panels having a contact angle of about 70° C.

Example 4

Ice adhesion forces of panels similar to the ones obtained via the processes described in Examples 1 and 2 were compared to the ice adhesion forces of untreated panels (contact angle about 70°). The apparatus employed was an SMS Texture Analyzer (TA-XT2). The panels used were cooled by passing the same through a channel of liquid nitrogen. Heat was also provided to control the temperature (0.1° C.) of the panels being tested. A Teflon® ring (15 mm diameter, 2 mm thick) was used to make a mock ice block. Wire and a cantilever on the texture analyzer were used to move the ring to create a shear force between ice in the ring and the panel. Prior to moving, 5 ml of water were dosed into the ring. The temperature of the plates was decreased within the range of −50° C. to −10° C. Once temperature was set, the resulting ice sample was kept stationary for about 3 minutes prior to being moved by the texture analyzer and force ($N/cm^2$) was assessed by moving the ice within the ring.

The results obtained indicate that the forces between the ice sample and panels treated according to this invention were between 35 and 100 percent less than the forces realized for the untreated aluminum panels, surprisingly indicating that the panels obtained according to this invention displayed excellent (i.e., low) ice adhesion results.

What is claimed is:

1. A frost-free device comprising parts whereby the parts are superhydrophobic and comprise nanoclusters of aluminum oxide, whereby the nanoclusters are between 800 nm to 15 microns in width, 700 nm to 10 microns in height and 300 nm to 40 microns apart, wherein the nanoclusters are pyramid-line in shape.

2. The frost-free device according to claim 1 wherein the part after being subjected to freezing conditions displays reduced ice build-up, reduced vapor condensation and/or reduced adhesion for ice when compared to parts free of nanoclusters of aluminum oxide.

3. A method for making a frost-free device, the method comprising the steps of:

obtaining an aluminum comprising part, the aluminum comprising part suitable for assembly into a new device or obtained from an existing device;

subjecting the aluminum comprising part to at least one electrochemical oxidation step for an effective amount of time to create a part comprising a fabricated anodic aluminum oxide layer thereon;

subjecting the part comprising the fabricated aluminum oxide layer thereon to an etching step or a coating step to produce a superhydrophobic part comprising aluminum oxide nanoclusters, wherein the nanoclusters of the superhydrophobic part are between 800 nm to 15 microns in width 700 nm to 10 microns in height and 300 nm to 40 microns apart, wherein the nanoclusters are pyramid-like in shape; and assembling the superhydrophobic part into the new or the existing device.

4. The method according to claim 3 wherein the aluminum comprising part is washed before the electrochemical oxidation step.

5. The method according to claim 3 wherein the fabricated anodic aluminum oxide layer is removed to produce a part having been subjected to a removal step.

6. The method according to claim 5 wherein the part having been subjected to a removal step is subjected to a second electrochemical oxidation step to produce the part comprising the anodic aluminum oxide layer fabricated thereon which is subjected to the etching step or coating step to produce the superhydrophobic part comprising aluminum oxide nanoclusters.

7. The method according to claim 6 wherein the anodic aluminum oxide layer is porous and comprises pores having diameters from 50 to 120 nm and a depth from 2 to 10 microns.

8. The method according to claim 6 wherein the anodic aluminum oxide layer has a pore interhole distance from 200 to 500 microns.

9. The method according to claim 6 wherein the anodic aluminum oxide layer is subjected to an etching step to produce the superhydrophobic part.

10. The method according to claim 9 wherein the superhydrophobic part is assembled into a freezer.

11. The method according to claim 3 wherein the aluminumcomprising part is obtained from a freezer.

12. The method according to claim 11 wherein the aluminum comprising part comprises a flat aluminum oxide layer that is about 3 to 10 microns thick.

13. The method according to claim 12 wherein the aluminum comprising part is subjected to one electrochemical oxidation step.

14. The method according to claim 13 wherein the electrochemical oxidation step adds 2 to 12 microns of fabricated anodic aluminum oxide layer to the flat aluminum oxide layer.

15. The method according to claim 14 wherein the panel comprising the anodic aluminum oxide layer comprises layered nanoclusters of aluminum oxide.

16. The method according to claim 15 wherein a laminate is applied to the part to make the panel superhydrophobic.

17. The method according to claim 3 wherein the part is a panel for a freezer.

18. The method according to claim 3 wherein the device is a freezer.

* * * * *